US006137452A

United States Patent [19]

Sullivan

[11] Patent Number: 6,137,452

[45] Date of Patent: Oct. 24, 2000

[54] DOUBLE SHOT ANTENNA

[75] Inventor: Jonathan L. Sullivan, Lincoln, Nebr.

[73] Assignee: Centurion International, Inc., Lincoln, Nebr.

[21] Appl. No.: 09/303,947

[22] Filed: May 3, 1999

[51] Int. Cl.[7] ..... H01Q 1/36

[52] U.S. Cl. ..... 343/873; 343/895; 29/600

[58] Field of Search ..... 343/873, 895, 343/906; 29/600; H01Q 1/36

[56] References Cited

U.S. PATENT DOCUMENTS 4,862,184 8/1989 Ploussios ..... 343/895

OTHER PUBLICATIONS

"Dual Frequency Helical Antennas For Handsets", Article Published Apr. 28, 1996 by Haapala et al.

*Primary Examiner*—Michael C. Wimer

*Attorney, Agent, or Firm*—Zarley, McKee, Thomte, Voorhees & Sease; Dennis L. Thomte

[57] ABSTRACT

A double shot antenna comprising a cylindrical coilform having first and second ends, and inner and outer surfaces. In one form of the invention, the inner and outer surfaces of the coilform have helical grooves formed therein which extend from the first end of the coilform towards the second end of the coilform. The coilform is comprised of a first material which resists metal plating. Plastic material is positioned in the helical grooves with the plastic material being plated with an electrically conductive material to form first and second radiating elements. A connector is provided at the first end of the coilform which is electrically connected to the first and second radiating elements. The method of manufacturing the antenna is also disclosed.

19 Claims, 4 Drawing Sheets

DOUBLE SHOT ANTENNA

BACKGROUND OF THE INVENTION

1. Field of the Invention

This invention relates to a double shot antenna and to the method of making the same. Although the radiators of the antenna are shown to be helical in shape, the radiators may have any shape. Certain electronic components such as antennas for wireless communications devices require radiating elements that are difficult to manufacture at the required tolerance. One such design is a dual band antenna that requires a smaller conductive helical element that passes precisely through the center of a larger conductive helical element. In such a design, it is very important for the two conductive elements to be held in a precise location with respect to each other both radially and axially. Another antenna that is difficult and expensive to manufacture is a quadrifilar helix antenna which is used primarily as a satellite antenna. A quadrifilar helix antenna requires four radiating elements running parallel to each other while spiraling around a common center axis.

2. Description of the Related Art

Antennas are currently being manufactured that require a helix-shaped conductor within a helix-shaped conductor. The conventional method for this type of construction is to machine a common connector from metal, attach the outer coil, attach the inner coil, and then use some sort of device that separates the two coils while maintaining the position of the coils precisely with respect to one another. In many cases, the coils are not held accurately enough to meet the performance requirements which results in the antennas being rejected. Further, the additional components increase the overall cost of the antenna, making it undesirable to the industry.

SUMMARY OF THE INVENTION

In one form of the invention, an assembly antenna for use on a wireless communications device is described comprising a cylindrical coilform having first and second ends, and inner and outer surfaces. The outer surface of the coilform has a helical groove formed therein which extends from the first end towards the second end. The inner surface of the coilform also has a helical groove formed thereof which extends from the first end towards the second end. The coilform is comprised of a first material which resists metal plating. A plastic material is positioned in each of the helical grooves with the plastic material being plated with an electrically conductive material to form first and second radiating elements. A plated connector is provided at the first end of the coilform which is physically and/or electrically connected to the first and second radiating elements. A cover encloses the assembly. The method of manufacturing the antenna is also described and comprises the steps of: (1) providing a cylindrical-shaped coilform having first and second ends, an outer cylindrical surface, an inner cylindrical surface, and helical grooves formed in the outer and inner cylindrical surfaces which spiral around the coilform from the first end towards the second end with the coilform being formed from a first material which resists metal plating; (2) placing the coilform into an injection mold cavity; (3) injecting plastic into the cavity to fill the helical grooves in the coilform and to create a connector at the one end of the coilform, with the plastic, which is injected into the cavity, being comprised of a material that will permit metal to adhere thereto; (4) removing the coilform from the cavity; (5) and plating the plastic material with a conductive metal material to create first and second radiating elements on the coilform and to create a conductive connector at the first end of the coilform which is electrically connected to the first and second radiating elements. The preferred shape of the radiators is helical, but they may have any shape.

It is therefore a principal object of the invention to provide an improved double shot molding process for creating an antenna for a wireless communications device.

Still another object of the invention is to provide a fast and efficient method of manufacturing antennas that require precision coils or other hard-to-manufacture conductive elements.

Still another object of the invention is to provide a method of manufacturing an antenna which positions two conductive elements in a precise location with respect to each other radially and axially.

Yet another object of the invention is to provide an antenna which is lightweight.

Still another object of the invention is to provide an antenna and the method of manufacturing the same which is economical of manufacture and durable in use.

These and other objects will be apparent to those skilled in the art.

DESCRIPTION OF THE PREFERRED EMBODIMENT

Figure 1:
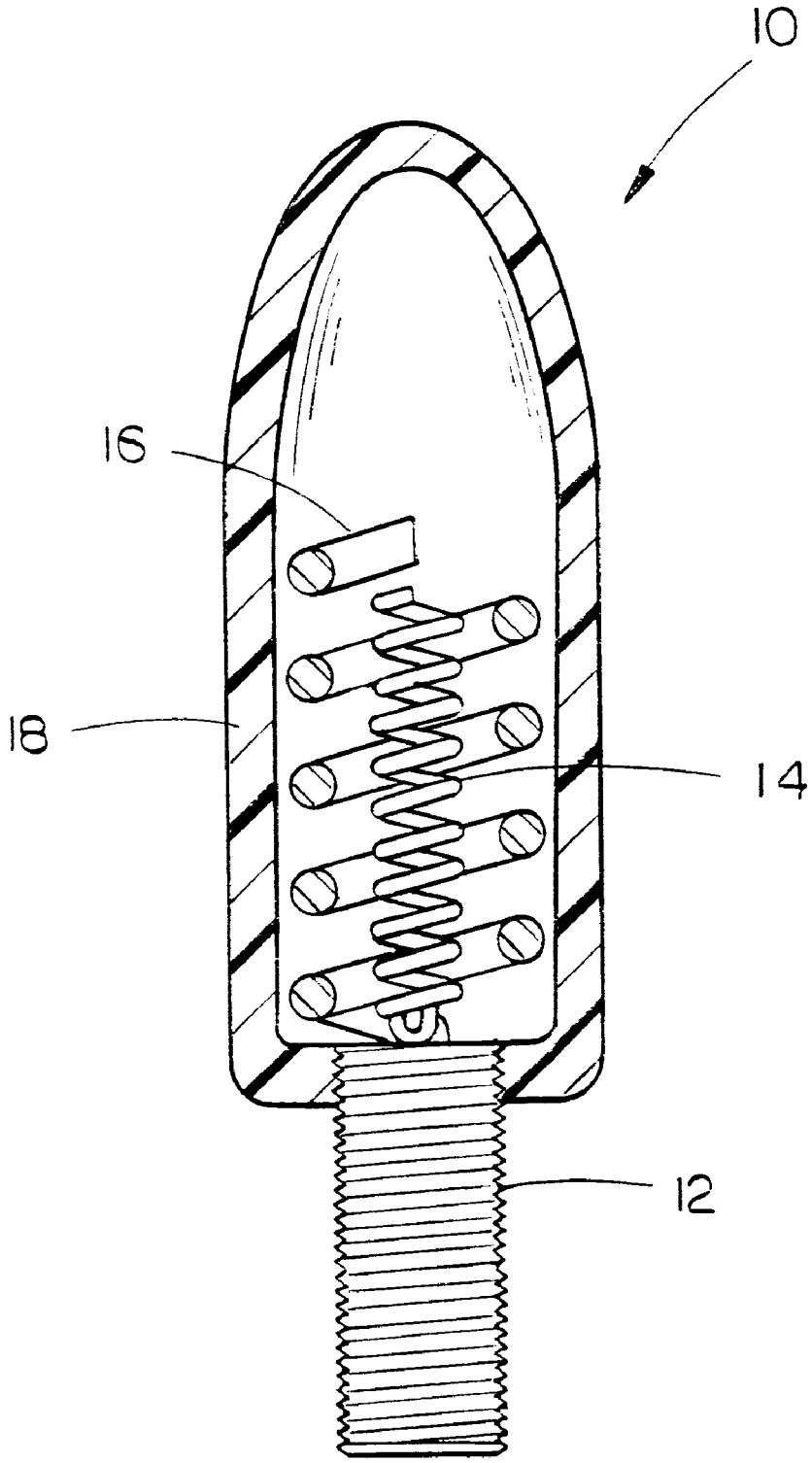
FIG. 1 (PRIOR ART)
FIG. 1 is a sectional view of a prior art antenna.

FIG. 1 illustrates a prior art dual band antenna 10 for use with a wireless communications device and which is manufactured using conventional techniques. Antenna 10 comprises connector 12, inner coil or radiating element 14, outer coil or radiating element 16, and antenna cover 18. Coils 14 and 16 are electrically attached to the connector 12 by either soldering or crimping. The antenna cover 18 is either insert molded or bonded to the antenna assembly. The structure of FIG. 1 and the method of manufacturing the same results in an antenna which is somewhat electrically inconsistent and which is relatively expensive to manufacture.

Figure 2:
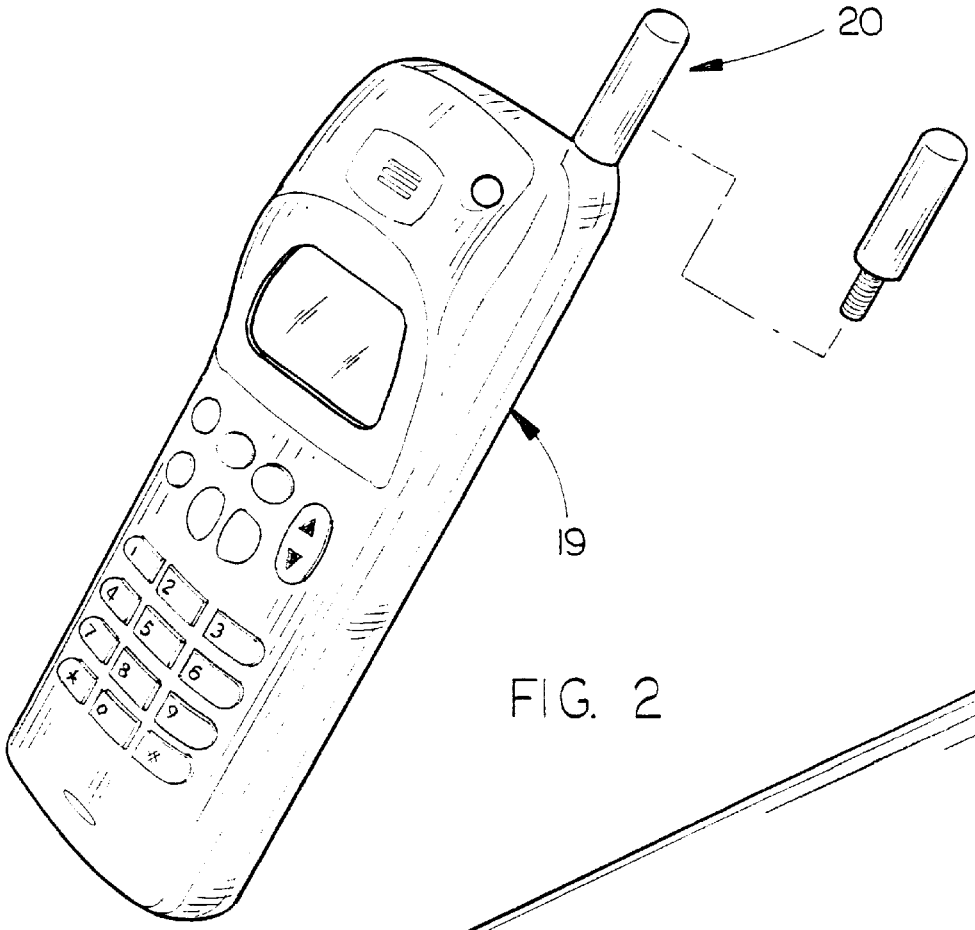
FIG. 2 is a perspective view illustrating the antenna of this invention mounted on a cellular telephone.
Figure 3:
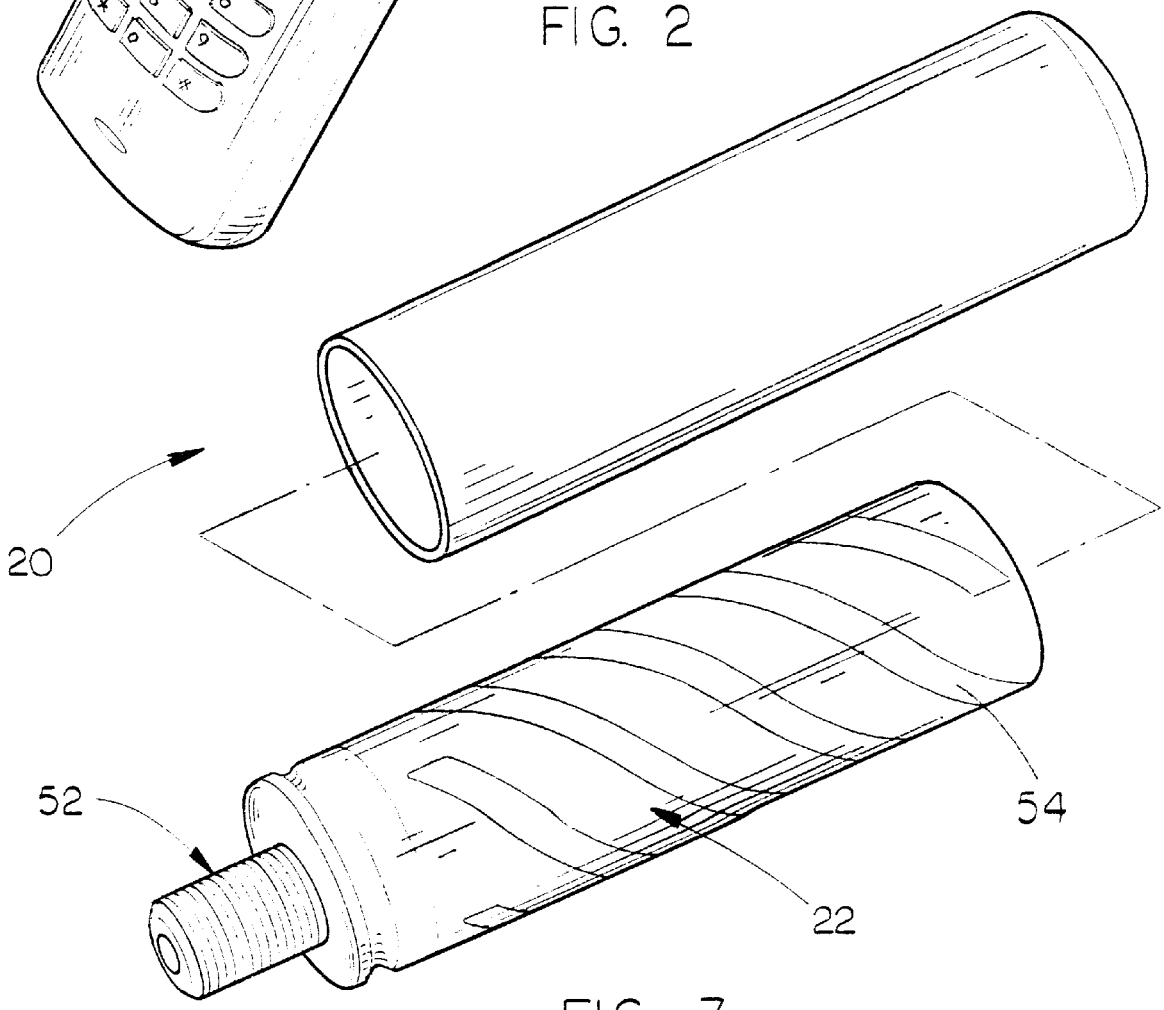
FIG. 3 is an exploded perspective view of the antenna of this invention.
Figure 4:
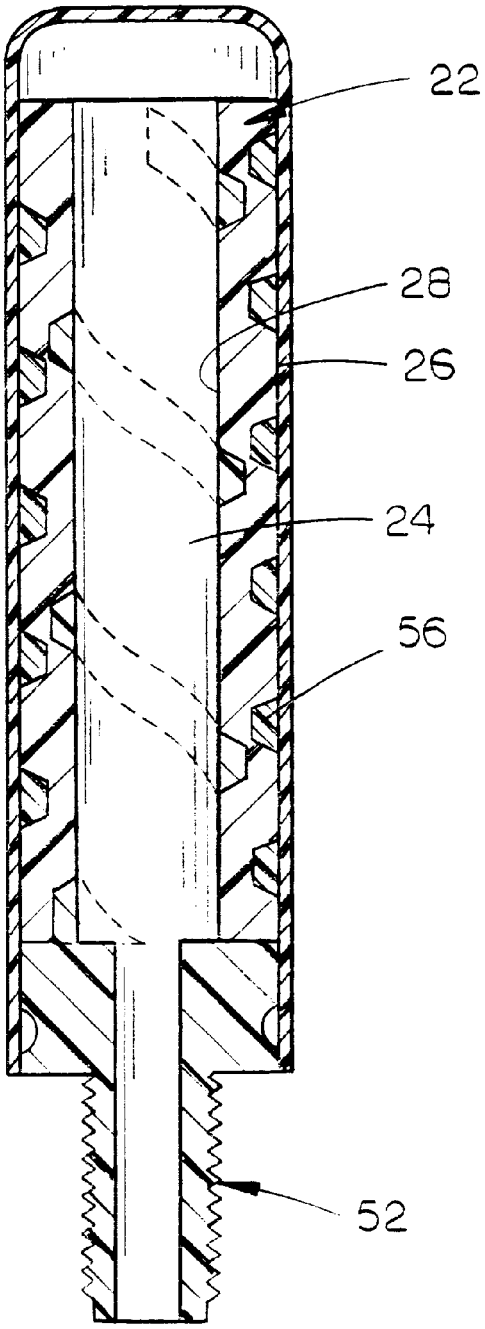
FIG. 4 is a sectional view of the antenna of this invention.
Figure 5:
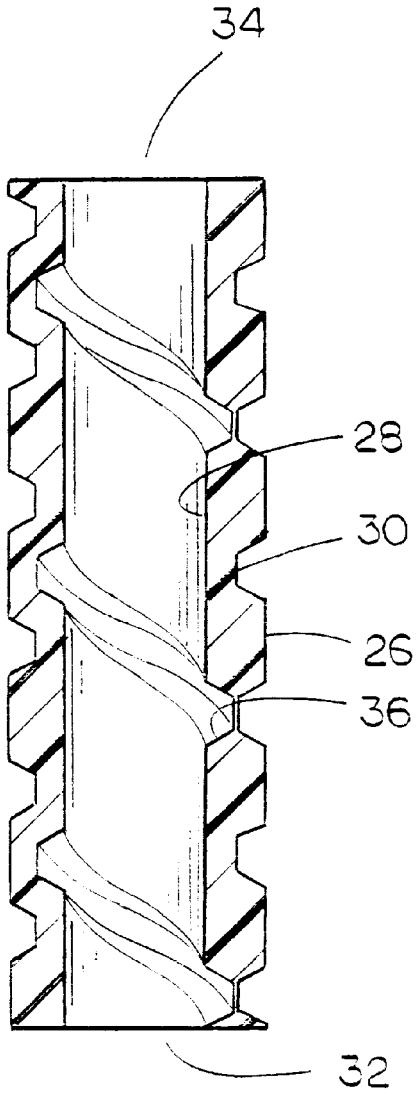
FIG. 5 is a sectional view of the coilform.

FIGS. 2–7 illustrate an antenna produced by the manufacturing process described hereinafter which is adapted for use with a wireless communications device such as a cellular telephone 19. In FIG. 2, the numeral 20 refers to the antenna of this invention. Antenna 20 includes a coilform 22 which may be created by molding, machining or other fabrication techniques. The coilform 22 may be made from a number of materials as long as the material resists plating during the conductive plating process to be conducted during the assembly of the antenna. One type of material which may be used would be a non-catalytic grade polymer (PES) sold by Amoco under the trademark RADEL.

Coilform 22 is generally cylindrical in shape and has an elongated bore 24 extending therethrough which is coaxial to the outside diameter. For purposes of description, coilform 22 will be described as having an outer surface 26 and an inner surface 28. The outside surface 26 of coilform 22 is provided with a helical groove 30 formed therein which spirals the full length of the part from end 32 to end 34. The inner surface 28 of coilform 22 is provided with a helical groove 36 formed therein which spirals the full length of the coilform 28. In the preferred embodiment, the helical groove 36 is utilized and, in some situations, it is conceivable that only the helical groove 30 on the outer surface of the coilform 22 will be required. Further, although a single groove 30 is disclosed as being formed in the outer surface of the coilform 22, a plurality of spaced-apart helical grooves could be provided on the coilform 22. Further, although a single helical groove 36 is disclosed as being formed in the inner surface 28 of the coilform 22, a plurality of spaced-apart helical grooves could also be formed in the inner surface 28 of the coilform 22. As stated above, although the preferred shape of the radiators is helical, the radiators could have any shape.

Figure 6:
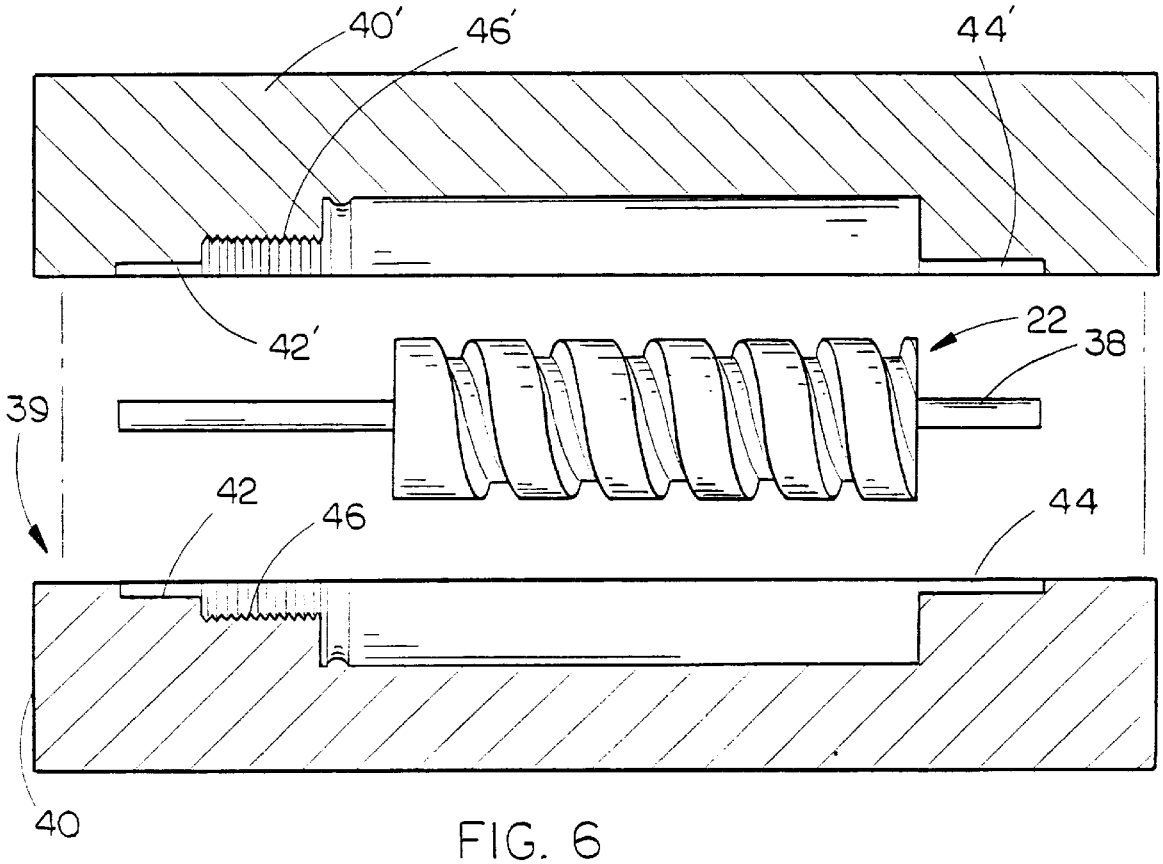
FIG. 6 is a sectional view illustrating the coilform being placed into a mold cavity.
Figure 7:
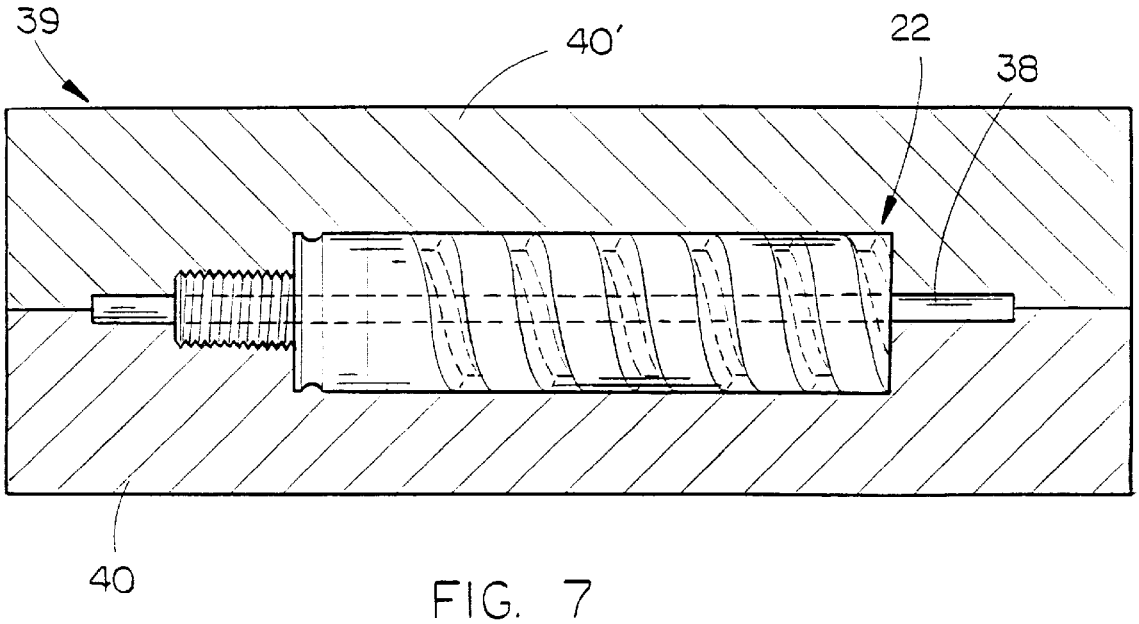
FIG. 7 is a sectional view illustrating the antenna in the mold cavity.

The coilform 22 is then placed onto a core pin 38, as illustrated in FIG. 6. The coilform 22 and the core pin 38 are placed into an injection mold cavity 39 including mold halves 40 and 40'. Mold halves 40 and 40' include portions 42, 44, and 42', 44', respectively, which receive the pins of the core pin 38 to precisely position the coilform in the cavity 39. Mold halves 40 and 40' also include cavity portions 46 and 46', respectively, which create one-half of a connector as will be described hereinafter. The mold halves 40 and 40' are clamped tightly together and heated plastic is injected into the mold cavity at a high velocity and pressure. The plastic flows into all areas of the cavity that are not occupied by the coilform. The plastic material which is used in the second stage molding is one that conductive metal will adhere to during the plating process. One material which may be used is a catalytic grade polymer (PC) sold by G.E. Plastics under the trademark LEXAN. The mold halves 40 and 40' are then separated to provide a connector 52, coilform 22, outer radiating element 54 and inner radiating element 56.

The second stage molding and coilform assembly are then plated with a conductive metal such as copper, nickel or gold. Due to the fact that the coilform 22 is made from a non-plateable material, the conductive material does not adhere to the areas between the radiating elements. Coilform 22 also acts as a built-in insulator that keeps the inner and outer radiating elements apart. The coilform 22 also acts as a dielectric load that may be used to decrease physical size of the antenna without degrading the electrical performance of the antenna. The plating will adhere only to the surface of the second stage molding material which consists of the inner and outer radiating elements 54 and 56 and the connector 52. When the plating process is complete, the antenna is finished by installing the cover 58 onto the antenna assembly being molded, snapped or bonded onto the antenna assembly.

Thus it can be seen that a novel double shot antenna has been provided which ensures that the inner and outer radiating elements will be precisely positioned with respect to one another. Further, the manufacturing process described herein is relatively inexpensive as compared to conventional methods of manufacturing antennas of the type described herein.

Thus it can be seen that the double shot antenna of this invention and the method of manufacturing the same accomplish at least all of the stated objectives.

I claim:

1. The method of manufacturing an antenna for a wireless communications device, comprising the steps of:

providing a cylindrical-shaped coilform having first and second ends, an outer cylindrical surface, and a groove formed in said outer cylindrical surface;

said coilform being formed from a first material which resists metal plating;

placing said coilform into an injection mold cavity;

injecting plastic into said cavity to fill the groove in said coilform and to create a connector at said one end of said coilform;

said plastic, which is injected into said cavity, being comprised of a plastic material that will permit metal to adhere thereto;

removing the coilform from said cavity;

and plating said plastic material with a conductive metal material to create a first radiating element on said coilform and to create a conductive connector at said first end of said coilform which is electrically connected to said first radiating element.

2. The method of claim 1 wherein an antenna cover is positioned over said coilform and said first radiating element.

3. The method of claim 1 wherein a plurality of spaced-apart grooves are formed in said outer cylindrical surface of said coilform and wherein each of said grooves are filled with said plastic material prior to being plated.

4. The method of claim 1 wherein said coilform has an inner cylindrical surface and wherein a second groove is formed in said inner cylindrical surface which is also filled with said plastic material, prior to being plated, to create a second radiating element which is electrically connected to said connector.

5. The method of claim 1 wherein said first material is comprised of a plastic material which resists the plating of metal thereto.

6. The method of claim 1 wherein said groove is helical and which spirals around said coilform from said first end towards said second end.

7. The method of claim 3 wherein each of said grooves are helical.

8. The method of claim 4 wherein said second groove is helical.

9. An antenna assembly for use on wireless communications devices, comprising:

a cylindrical coilform having first and second ends, and an outer surface;

said outer surface of said coilform having a groove formed therein;

said coilform being comprised of a first material which resists metal plating;

a plastic material in said groove;

said plastic material being plated with an electrically conductive material to form a first radiating element;

and a connector at said first end of said coilform which is electrically connected to said first radiating element.

10. The assembly of claim 9 wherein said connector is comprised of the same plastic material as the plastic material in said groove and wherein said connector is plated with the same electrically conductive material as is plated onto said plastic material in said groove.

11. The assembly of claim 10 wherein said coilform has an inner surface and wherein a second groove is formed in said inner surface, said second groove being filled with the same plastic material which fills said first groove, said plastic material in said second groove being plated with the same material as is plated onto said plastic material in said first groove; the plated plastic material in said second groove being electrically connected to said connector to form a second radiating element.

12. The assembly of claim 9 wherein a plurality of spaced-apart grooves are formed in the outer surface of said coilform and wherein each of said grooves are filled with a plated plastic material to form a plurality of radiating elements.

13. The assembly of claim 12 wherein said coilform has an inner surface and wherein a plurality of spaced-apart grooves are formed in said inner surface which are filled with plated plastic material to form a plurality of radiating elements.

14. The assembly of claim 9 wherein a cover encloses said coilform and said radiating element.

15. The assembly of claim 9 wherein said groove is helical.

16. The assembly of claim 10 wherein said groove is helical.

17. The assembly of claim 11 wherein said first and second grooves are helical.

18. The assembly of claim 12 wherein said grooves are helical.

19. The assembly of claim 13 wherein said grooves are helical.

* * * * *